US009646760B2

(12) United States Patent
Imanishi et al.

(10) Patent No.: US 9,646,760 B2
(45) Date of Patent: May 9, 2017

(54) COMMON MODE CHOKE COIL

(71) Applicant: SHT Corporation Limited, Izumisano-shi, Osaka (JP)

(72) Inventors: Tsunetsugu Imanishi, Izumisano (JP); Yasuomi Takahashi, Izumisano (JP); Masafumi Inoue, Izumisano (JP)

(73) Assignee: SHT Corporation Limited, Osaka (JP)

( * ) Notice: Subject to any disclaimer, the term of this patent is extended or adjusted under 35 U.S.C. 154(b) by 0 days.

(21) Appl. No.: 14/972,503

(22) Filed: Dec. 17, 2015

(65) Prior Publication Data

US 2016/0189857 A1 Jun. 30, 2016

(30) Foreign Application Priority Data

Dec. 26, 2014 (JP) ..... 2014-266264

(51) Int. Cl.

| | |
|---|---|
| ***H01F 27/30*** | (2006.01) |
| ***H01F 27/28*** | (2006.01) |
| ***H01F 27/24*** | (2006.01) |
| ***H01F 27/32*** | (2006.01) |
| ***H01F 5/02*** | (2006.01) |
| ***H01F 37/00*** | (2006.01) |
| ***H01F 27/29*** | (2006.01) |
| *H01F 17/00* | (2006.01) |

(52) U.S. Cl.

CPC ..... *H01F 27/325* (2013.01); *H01F 5/02* (2013.01); *H01F 27/2823* (2013.01); *H01F 27/2847* (2013.01); *H01F 27/29* (2013.01); *H01F 37/00* (2013.01); *H01F 2017/0093* (2013.01)

(58) Field of Classification Search

USPC ..... 336/90

See application file for complete search history.

(56) References Cited

U.S. PATENT DOCUMENTS

2012/0306609 A1 12/2012 Kato

FOREIGN PATENT DOCUMENTS

| | | |
|---|---|---|
| JP | H06 295834 A | 10/1994 |
| JP | H11 273975 A | 10/1999 |
| JP | 2013-12702 | 1/2013 |

OTHER PUBLICATIONS

European Search Report and Annex to the European Search Report on European Patent Application No. EP 15 20 0278, dated May 3, 2016 (7 pages).

*Primary Examiner* — Elvin G Enad
*Assistant Examiner* — Ronald Hinson
(74) *Attorney, Agent, or Firm* — Buchanan Ingersoll & Rooney PC

(57) ABSTRACT

The present invention provides a common mode choke coil that has a higher coupling factor than that of a conventional common mode choke coil and that is easy to be assembled. A common mode choke coil according to the present invention includes a first coil portion 51 and a second coil portion 52 that are connected to each other in series, and a third coil portion 53 and a fourth coil portion 54 that are connected to each other in series. The first coil portion 51 and the second coil portion 52 are respectively disposed in the first quadrant and the third quadrant of an orthogonal coordinate system and housed in a first bobbin 8*a*, and the third coil portion 53 and the fourth coil portion 54 are respectively disposed in the fourth quadrant and the second quadrant of the orthogonal coordinate system and housed in a second bobbin 8*b*. The first bobbin 8*a* and the second bobbin 8*b* are fitted to each other, and thereby adjacent case portions of the two bobbins are bonded to each other.

6 Claims, 7 Drawing Sheets

COMMON MODE CHOKE COIL

BACKGROUND OF THE INVENTION

1. Field of the Invention

The present invention relates to a common mode choke coil for suppressing common mode noise.

2. Description of Related Art

A common mode choke coil can be composed of at least two coil portions, but in order to improve the amount of attenuation to suppress common mode noise, to reduce the size and the thickness, or to add a protection function, a common mode choke coil composed of a combination of many more coils is used (JP 2013-12702A). As shown in FIG. 14, a common mode choke coil 10 includes a first coil portion 11 and a second coil portion 12 that are connected to each other in series between a first terminal T1 and a second terminal T2 provided on a first transmission line of two balanced lines connecting from a power source to a load, and a third coil portion 13 and a fourth coil portion 14 that are connected to each other in series between a third terminal T3 and a fourth terminal T4 provided on a second transmission line of the two balanced lines. Each coil portion is produced by a conducting wire being spirally wound around an annular ferrite core.

Here, the first coil portion 11 and the second coil portion 12 are wound in mutually opposite directions, and the third coil portion 13 and the fourth coil portion 14 are also wound in mutually opposite directions. Also, the first coil portion 11 and the third coil portion 13 are wound in mutually opposite directions, and the second coil portion 12 and the fourth coil portion 14 are also wound in mutually opposite directions.

In the common mode choke coil, magnetic saturation of the cores caused by the magnetic force generated by load current can be suppressed by bringing the coupling factor between the two coil portions of the first transmission line and the two coil portions of the second transmission line of a magnetic circuit constituted by the four coil portions closer to 1 while ensuring high electric insulation property (voltage resistance characteristics) between the two coil portions of the first transmission line and the two coil portions of the second transmission line, and thus an even higher inductance value can be ensured, and common mode noise flowing toward the power source side can be suppressed more effectively. In addition, if it is unnecessary to increase the inductance value, the reduction in size and weight can be achieved, and it is possible to suppress a set mounting space in which the common mode choke coil is to be mounted, and simplify the attachment structure. It is also thereby possible to reduce the cost of the common mode choke coil and the mounting set.

With the common mode choke coil 10, the four coil portions 11, 12, 13 and 14 are each housed in a case-like bobbin made of an insulating resin, and thereby four independent coil elements are produced. The four coil elements are engaged to each other, and thereby the unitary common mode choke coil 10 having four terminals is assembled.

However, in the conventional common mode choke coil 10, the four coil portions 11, 12, 13 and 14 are respectively disposed in four quadrants of an orthogonal coordinate system in the order of the first quadrant, the second quadrant, the fourth quadrant and the third quadrant so as to be as close to each other as possible (not shown) such that the first coil portion 11 of the first transmission line and the third coil portion 13 of the second transmission line are brought closer to each other while ensuring an insulation distance, and also that the second coil portion 12 of the first transmission line and the second coil portion 14 of the second transmission line are brought closer to each other while ensuring the insulation distance so as to increase the coupling factor while obtaining electric insulation property between the first transmission line and the second transmission line. However, the common mode choke coil 10 is problematic in that the coupling factor is still as low as about 0.94 to 0.96 due to the spatial distance between coil portions being large.

In addition, in the manufacturing process of the conventional common mode choke coil 10, the four coil portions 11, 12, 13 and 14 are respectively housed in four bobbins to produce four coil elements, and thereafter in a state in which the four coil elements are respectively disposed in four quadrants of an orthogonal coordinate system in the order of the first quadrant, the second quadrant, the fourth quadrant and the third quadrant, it is necessary to perform an operation of causing an annular core to pass through the inner spaces of the four coil portions and bundling the coil elements together by using some kind of clamping member. Accordingly, positioning of the coil elements becomes unstable and inaccurate, as a result of which fixing of the coil elements with the use of a clamping member becomes unstable, which requires an additional need to use a molded structure for fixing the coil elements, and causes many problems such as the assembling operation being complex and inaccurate, and an additional component being required as a countermeasure, which results in a squeeze on the cost.

SUMMARY OF THE INVENTION

In view of the above, it is an object of the present invention to provide a common mode choke coil that has a higher coupling factor than that of a conventional common mode choke coil and that is easy to be assembled.

A common mode choke coil according to the present invention is a common mode choke coil including: a plurality of coil portions wherein pairs of coil portions connected in series to each other are respectively provided in a plurality of transmission lines connecting a power source and a load, the plurality of coil portions being disposed along one plane, wherein each of the pairs of coil portions are disposed in diagonally opposite positions with an origin of a two-dimensional coordinate system being set as a center, and are housed in a shared bobbin formed extending across the diagonally opposite positions, the bobbin includes a pair of rectangular cylindrical case portions that house the pair of coil portions, a coupling portion that diagonally couples the pair of case portions and that extends to a middle in a height direction of the case portions, and a recess portion that is continuous with the coupling portion and that is formed between corners of the case portions that are adjacent to each other, and a plurality of the bobbins are coupled by fitting the coupling portion of one of the bobbins to the recess portion of the other bobbin.

A common mode choke coil according to the present invention is a common mode choke coil including: a first coil portion and a second coil portion that are connected in series to each other between a first terminal and a second terminal; and a third coil portion and a fourth coil portion that are connected in series to each other between a third terminal and a fourth terminal, the four coil portions being respectively disposed in four quadrants of an orthogonal coordinate system, and an annular core passing through inner spaces of the four coil portions, wherein the first coil portion and the second coil portion are respectively disposed in a first quadrant and a third quadrant of the orthogonal coordinate system and housed in a first bobbin, and the third coil portion and the fourth coil portion are respectively disposed in a fourth quadrant and a second quadrant of the orthogonal coordinate system and housed in a second bobbin, the first bobbin includes a pair of rectangular cylindrical case portions that house the first coil portion and the second coil portion, a coupling portion that diagonally couples the pair of case portions and that extends to a middle in a height direction of the case portions, and a recess portion that is continuous with the coupling portion and that is formed between corners of the case portions that are adjacent to each other, the second bobbin includes a pair of rectangular cylindrical case portions that house the third coil portion and the fourth coil portion, a coupling portion that diagonally couples the pair of case portions and that extends to a middle in a height direction of the case portions, and a recess portion that is continuous with the coupling portion and that is formed between corners of the case portions that are adjacent to each other, and the first bobbin and the second bobbin are coupled by fitting the coupling portion of one of the bobbins to the recess portion of the other bobbin, the pair of case portions of the first bobbin are disposed in the first quadrant and the third quadrant of the orthogonal coordinate system, and the pair of case portions of the second bobbin are disposed in the fourth quadrant and the second quadrant of the orthogonal coordinate system.

Desirably, the first coil portion and the fourth coil portion are coaxially disposed, the second coil portion and the third coil portion are coaxially disposed, the first coil portion and the third coil portion are arranged side by side in parallel to each other, and the second coil portion and the fourth coil portion are arranged side by side in parallel to each other.

Also, desirably, the first bobbin and the second bobbin have the same shape.

More desirably, the first bobbin and the second bobbin are each formed by two bobbin pieces of the same shape being bonded to each other.

It is possible that the first coil portion and the second coil portion are produced by one conducting wire being continuously wound, the first coil portion and the second coil portion are connected to each other via a connecting portion, the third coil portion and the fourth coil portion are produced by one conducting wire being continuously wound, and the third coil portion and the fourth coil portion are connected to each other via a connecting portion.

With the common mode choke coil according to the present invention, a pair of coil portions that are to be connected to one transmission line are disposed in diagonally opposite positions on the plane, and the pair of coil portions that are to be connected to one transmission line and a pair of coil portions that are connected to another transmission line are combined in mutually opposite positional relation, and thus the spatial distance between the two coil portions constituting the first transmission line and the two coil portions constituting the second transmission line is shortened with respect to that of a conventional common mode choke coil. As a result, the coupling factor between a plurality of transmission lines in a magnetic circuit formed by a plurality of coil portions is increased to be higher than that of a conventional common mode choke coil.

Also, with the common mode choke coil according to the present invention, each pair of coil portions that are to be connected to one transmission line are housed in a bobbin, then, the bobbins are fitted to each other, and thereby one common mode choke coil is assembled. Accordingly, in the manufacturing process, by separately producing a plurality of bobbins in which coil portions are housed, and thereafter fitting the bobbins to each other, a coil assembly can be obtained, and thus the assembling operation becomes easier than a conventional assembling operation.

DETAILED DESCRIPTION OF THE INVENTION

Hereinafter, an embodiment of the present invention will be specifically described with reference to the drawings.

Figure 13:
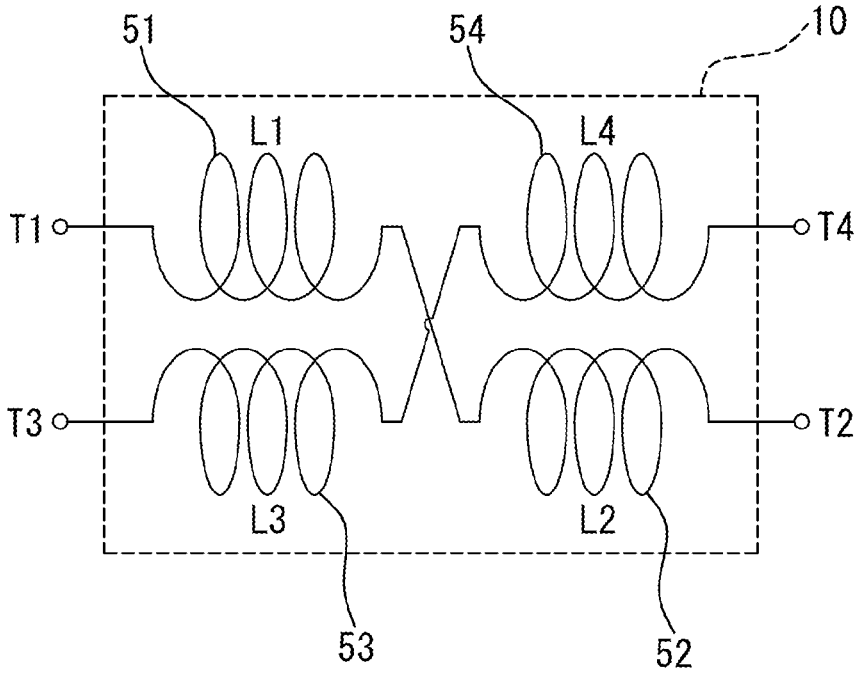
FIG. 13 is a circuit diagram of a common mode choke coil according to the present invention.
Figure 14:
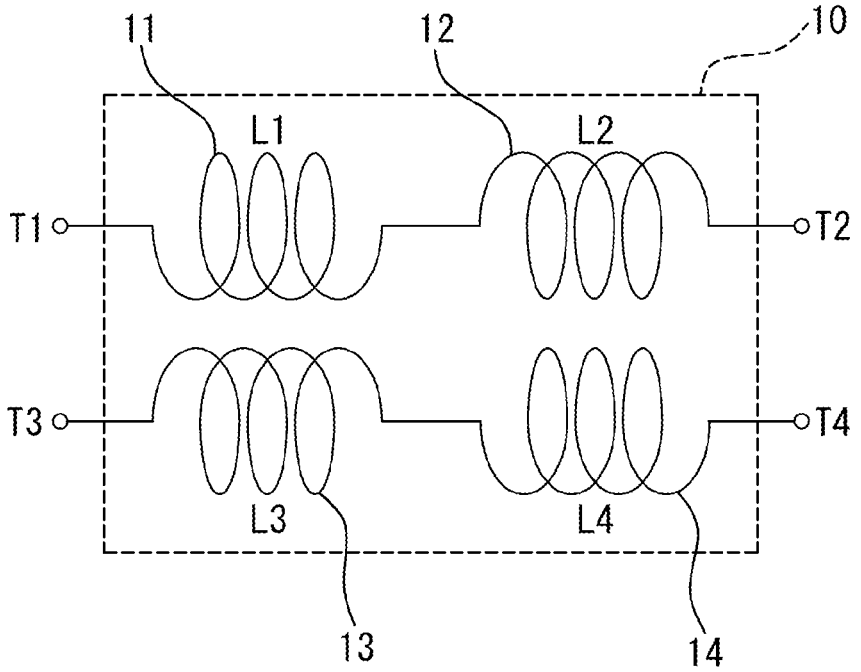
FIG. 14 PRIOR ART
FIG. 14 is a circuit diagram of a conventional common mode choke coil.

As shown in FIG. 13, a common mode choke coil 1 according to the present invention includes a first coil portion 51 and a second coil portion 52 that are connected to each other in series between a first terminal T1 and a second terminal T2 provided on a transmission line, and a third coil portion 53 and a fourth coil portion 54 that are connected to each other in series between a third terminal T3 and a fourth terminal T4 provided on another transmission line, the four coil portions 51, 52, 53 and 54 being respectively disposed in four quadrants of an orthogonal coordinate system.

Figure 1:
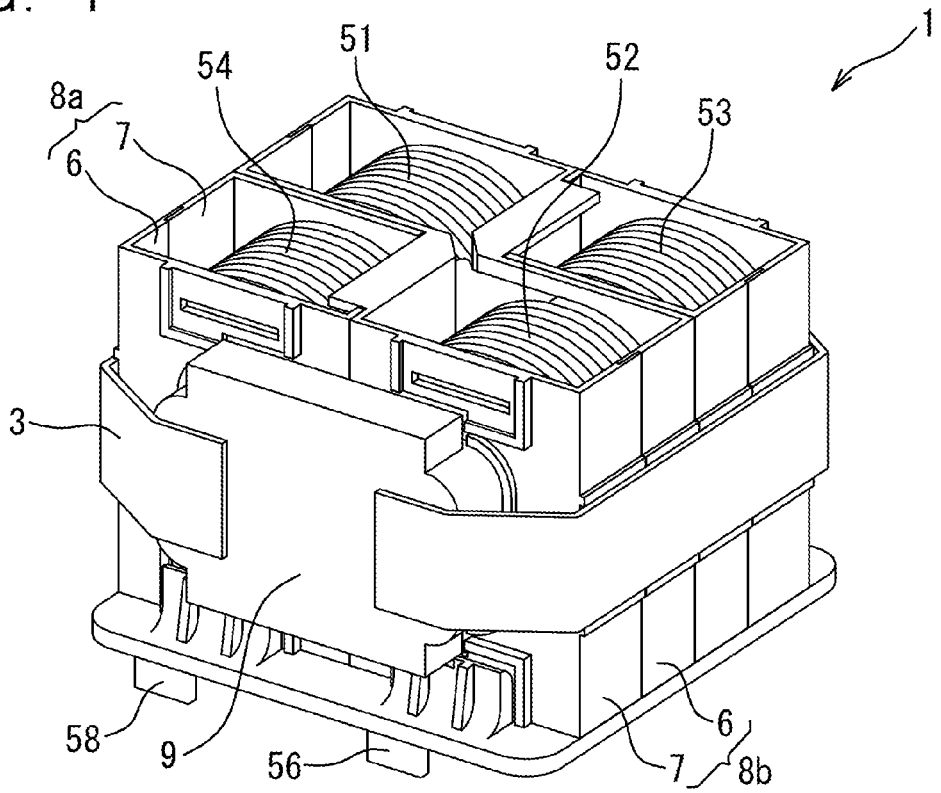
FIG. 1 is a perspective view of a common mode choke coil according to an embodiment of the present invention.

As shown in FIG. 1, in the common mode choke coil 1, the first coil portion 51 and the second coil portion 52 are respectively disposed in the first quadrant and the third quadrant of an orthogonal coordinate system so as to be positioned in diagonal relation, with the origin of the orthogonal coordinate system being set as the center, and the third coil portion 53 and the fourth coil portion 54 are respectively disposed in the fourth quadrant and the second quadrant of the orthogonal coordinate system so as to be positioned in diagonal relation, with the origin of the orthogonal coordinate system being set as the center.

Figure 2:
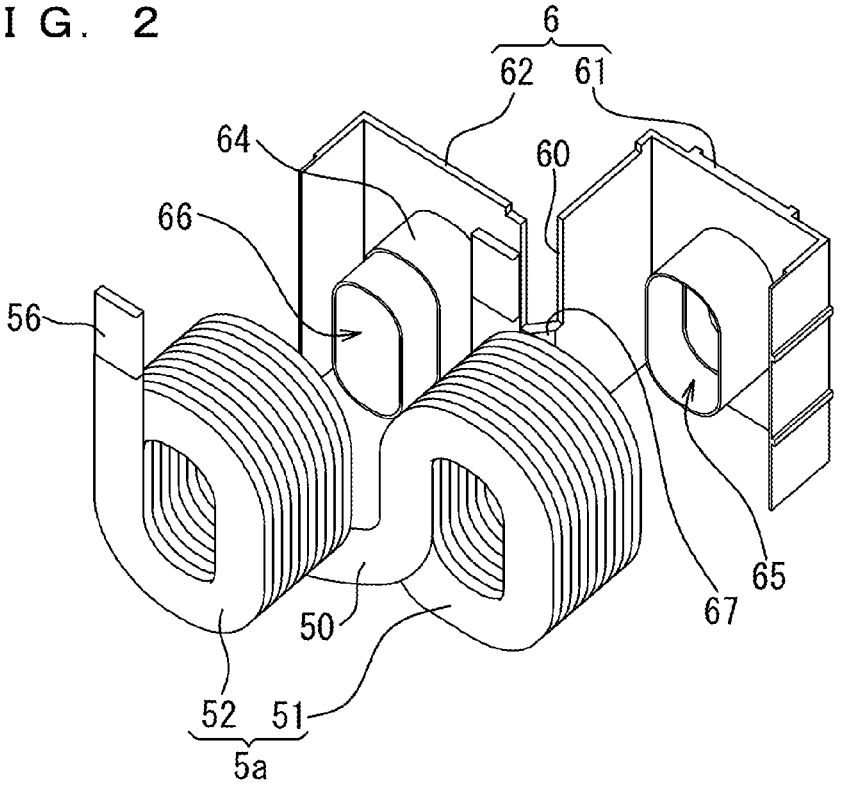
FIG. 2 is a perspective view of a coil pair and a bobbin piece.

As shown in FIG. 2, the first coil portion 51 and the second coil portion 52 are formed by one flat wire being spirally wound, and the first coil portion 51 and the second coil portion 52 are coupled to each other by a connecting portion 50, and a first coil pair 5*a* is thereby formed. Each of the first coil portion 51 and the second coil portion 52 can be wound in, for example, a substantially oval shape.

Figure 6:
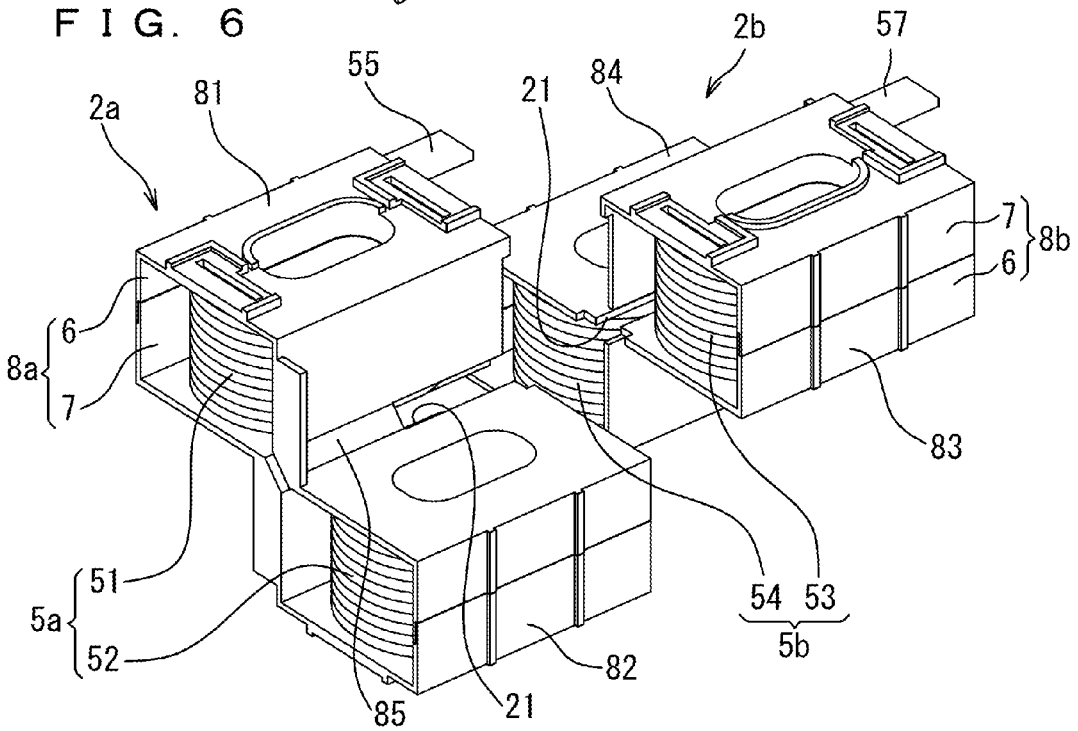
FIG. 6 is a perspective view showing a first coil element and a second coil element.
Figure 7:
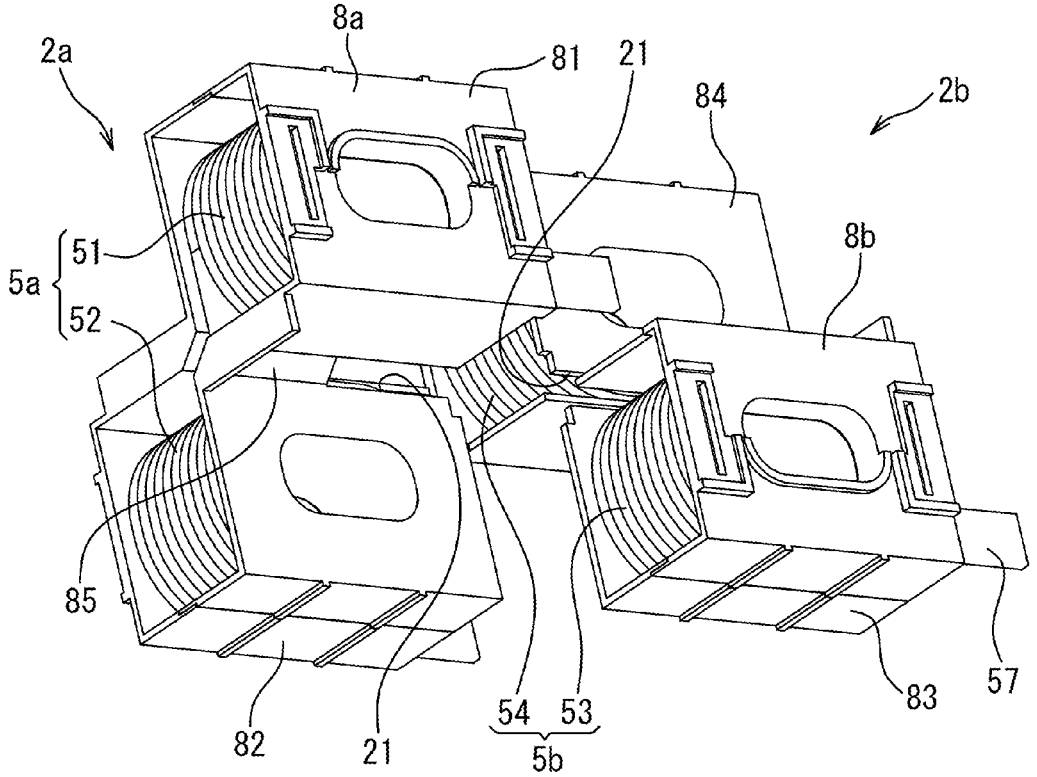
FIG. 7 is a perspective view of the first coil element and the second coil element as viewed from another direction.

Likewise, as shown in FIG. 6, the third coil portion 53 and the fourth coil portion 54 are formed by one flat wire being spirally wound, and the third coil portion 53 and the fourth coil portion 54 are coupled to each other by a connecting portion (not shown), and a second coil pair 5*b* is thereby formed. Each of the third coil portion 53 and the fourth coil portion 54 can be wound in, for example, a substantially oval shape.

Here, the first coil portion 51 and the second coil portion 52 are wound in opposite directions, and the third coil portion 53 and the fourth coil portion 54 are also wound in opposite directions. The first coil portion 51 and the third coil portion 53 are wound in the same direction, and the second coil portion 52 and the fourth coil portion 54 are also wound in the same direction.

Figure 8:
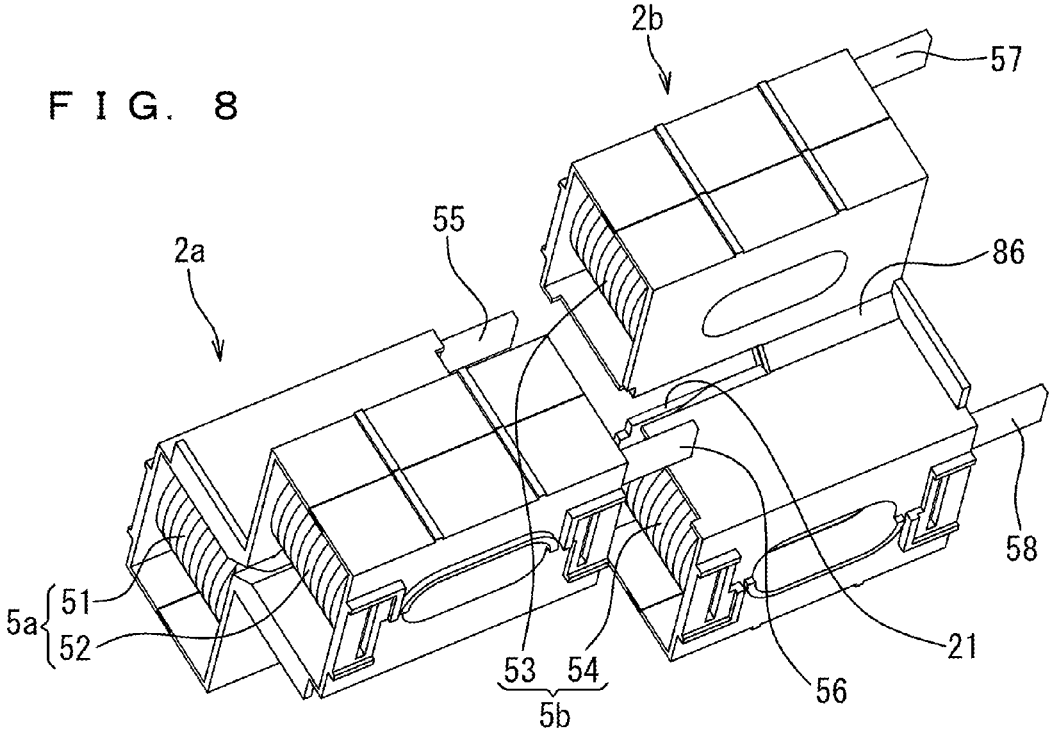
FIG. 8 is a perspective view of the first coil element and the second coil element as viewed from still another direction.
Figure 9:
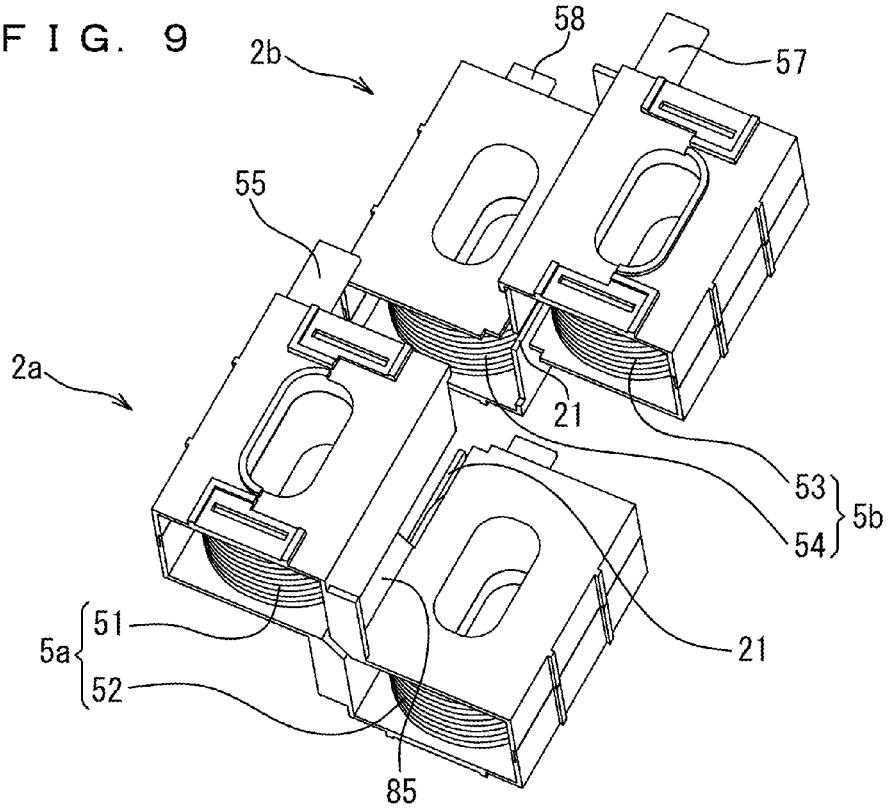
FIG. 9 is a perspective view of the first coil element and the second coil element as viewed from still another direction.

As shown in FIG. 8, a first lead portion 55 is drawn from the first coil portion 51, a second lead portion 56 is drawn from the second coil portion 52, a third lead portion 57 is drawn from the third coil portion 53, and a fourth lead portion 58 is drawn from the fourth coil portion 54. The four lead portions 55, 56, 57 and 58 constitute four terminals T1, T2, T3 and T4 shown in FIG. 13.

As shown in FIGS. 6 to 9, the first coil pair 5*a* is housed in a first bobbin 8*a*, and the second coil pair 5*b* is housed in a second bobbin 8*b*.

The first bobbin 8*a* and the second bobbin 8*b* are each formed by two bobbin pieces 6 and 7 being bonded to each other.

Figure 3:
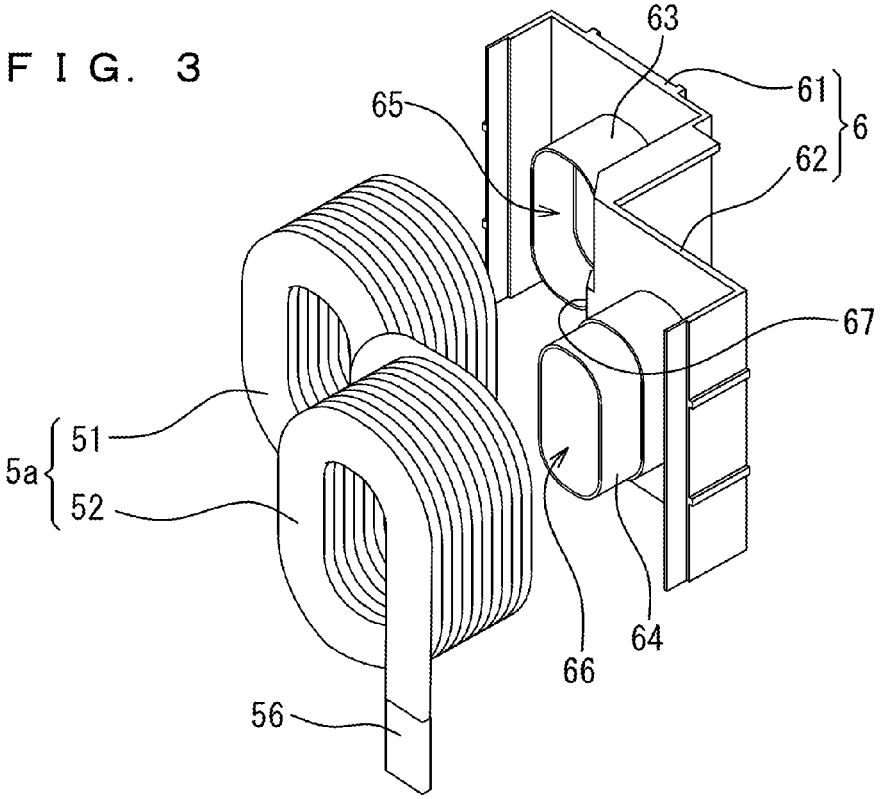
FIG. 3 is a perspective view of the coil pair and the first bobbin piece as viewed from another direction.

A first bobbin piece 6 is a unitary resin molded article. As shown in FIGS. 2 and 3, the bobbin piece 6 includes a first bobbin portion 61 having a U shaped (angular C-shaped) perimeter wall and a second bobbin portion 62 having an L-shaped perimeter wall that are coupled to each other. A cylinder portion 63 having a through hole 65 extending in a coil axis direction is provided so as to protrude from an inner surface of the first bobbin portion 61, and a cylinder portion 64 having a through hole 66 extending in the coil axis direction is provided so as to protrude from an inner surface of the second bobbin portion 62. Also, the first bobbin portion 61 and the second bobbin portion 62 are coupled by a coupling piece 67. The coupling piece 67 extends to the middle in a height direction, which is perpendicular to the coil axis, of the first bobbin portion 61 and the second bobbin portion 62, and a notch 60 is provided between the bobbin portions 61 and 62 so as to be continuous with the coupling piece 67. In the illustration, the coupling piece 67 extends to end portions of the bobbin portions 61 and 62, but does not necessarily extend to the end portions as long as the coupling piece 67 extends to the middle in the height direction.

Figure 4:
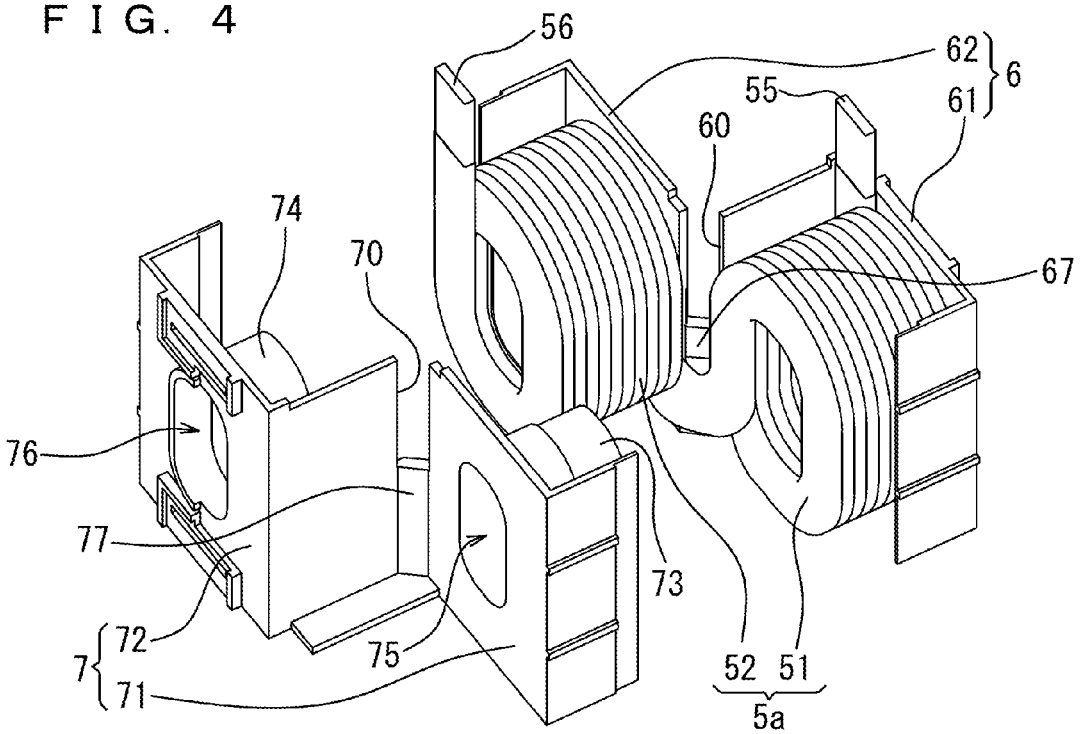
FIG. 4 is a perspective view showing an assembled state of the coil pair and the bobbin piece and a second bobbin piece.
Figure 5:
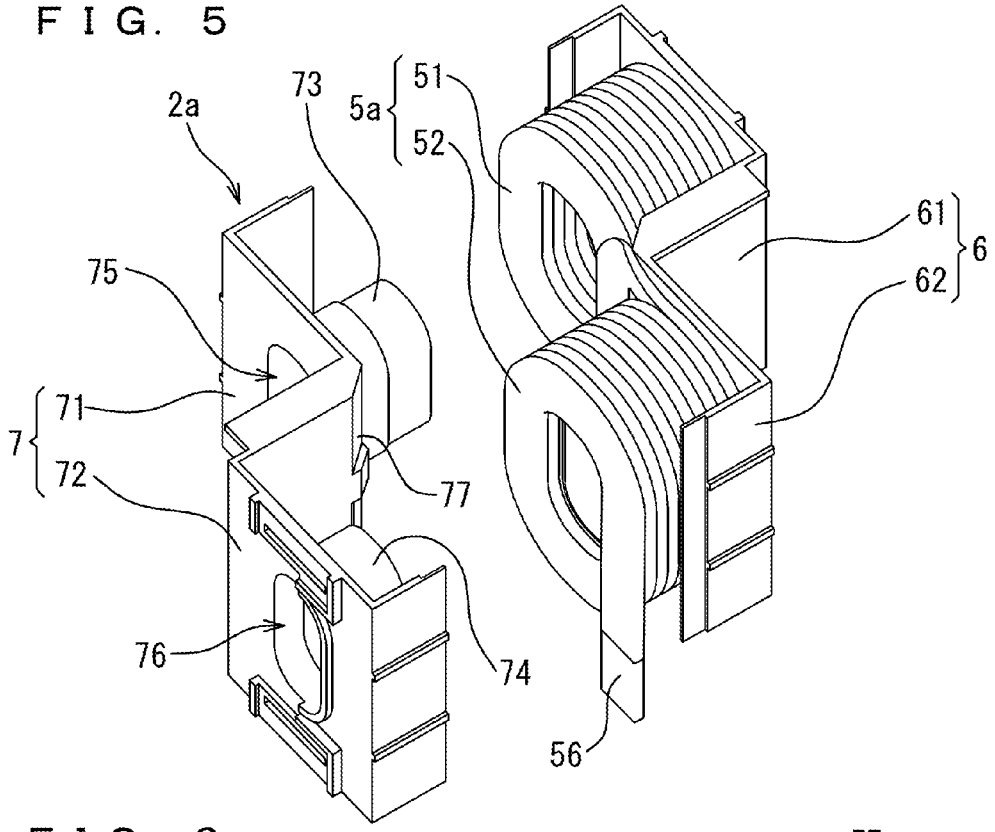
FIG. 5 is a perspective view showing an assembled state of the coil pair and the bobbin piece and the second bobbin piece as viewed from another direction.

A second bobbin piece 7 is a unitary resin molded article. As shown in FIGS. 4 and 5, the bobbin piece 7 includes a first bobbin portion 71 having an L-shaped perimeter wall and a second bobbin portion 72 having a U-shaped (angular C-shaped) perimeter wall that are coupled to each other. A cylinder portion 73 having a through hole 75 extending in the coil axis direction is provided so as to protrude from an inner surface of the first bobbin portion 71, and a cylinder portion 74 having a through hole 76 extending in the coil axis direction is provided so as to protrude from an inner surface of the second bobbin portion 72. Also, the first bobbin portion 71 and the second bobbin portion 72 are coupled by a coupling piece 77. The coupling piece 77 extends to the middle in a height direction, which is perpendicular to the coil axis, of the first bobbin portion 71 and the second bobbin portion 72, and a notch 70 is provided between the bobbin portions 71 and 72 so as to be continuous with the coupling piece 77. In the illustration, the coupling piece 77 extends to end portions of the bobbin portions 71 and 72, but does not necessarily extend to the end portions as long as the coupling piece 77 extends to the middle in the height direction.

The reason that the heights of the coupling pieces 67 and 77 are defined as described above is to perform positioning such that front ends of coupling portions 85 and 86 constituted by the coupling pieces 67 and 77 come into contact with each other when coil elements 2*a* and 2*b*, which will be described later, are combined.

Here, the two bobbin pieces 6 and 7 are formed by using the same die and have the same shape. As shown in FIGS. 4 and 5, the first bobbin piece 6 and the second bobbin piece 7 are disposed so as to be right-left reversed, and bonded to each other. By doing so, the two cylinder portions 63 and 64 of the first bobbin piece 6 and the two cylinder portions 73 and 74 of the second bobbin piece 7 are coaxially butted against each other, and thereby two parallel core insertion holes are formed.

As shown in FIGS. 6 to 9, the first bobbin 8*a* constituted by two bobbin pieces 6 and 7 that are bonded to each other includes a rectangular cylindrical first case portion 81 that houses the first coil portion 51 and a rectangular cylindrical second case portion 82 that houses the second coil portion 52. The first case portion 81 and the second case portion 82 are diagonally coupled to each other by a coupling portion 85 where the coupling pieces 67 and 77 overlap each other. A space between adjacent corners of the case portions 81 and 82 at which the coupling portion 85 is not formed is a recess portion 21 that is continuous with the coupling portion 85 and that is constituted by the notches 60 and 70.

The first case portion 81 and the second case portion 82 of the first bobbin 8*a* have a positional relationship in which they are disposed in the first quadrant and the third quadrant of an orthogonal coordinate system, and are positioned in diagonal relation to each other with the origin of the orthogonal coordinate system being set as the center.

Likewise, the second bobbin 8*b* constituted by two bobbin pieces 6 and 7 that are bonded to each other includes a rectangular cylindrical third case portion 83 that houses the third coil portion 53 and a rectangular cylindrical fourth case portion 84 that houses the fourth coil portion 54. The third case portion 83 and the fourth case portion 84 are diagonally coupled to each other by a coupling portion 86 where the coupling pieces 67 and 77 overlap each other. A space between adjacent corners of the case portions 83 and 84 at which the coupling portion 86 is not formed is a recess portion 21 that is continuous with the coupling portion 86 and that is constituted by the notches 60 and 70.

The third case portion 83 and the fourth case portion 84 of the second bobbin 8*b* have a positional relationship in which they are disposed in the fourth quadrant and the second quadrant of the orthogonal coordinate system, and are positioned in diagonal relation to each other with the origin of the orthogonal coordinate system being set as the center.

The first bobbin 8*a* and the second bobbin 8*b* formed in the manner as described above have the same shape, and as a result of the first bobbin 8*a* and the second bobbin 8*b* being disposed so as to be upside down to each other, the recess portion 21 of the first bobbin 8*a* and the recess portion 21 of the second bobbin 8*b* are opposed to each other.

In the first bobbin 8*a*, the first coil pair 5*a* is housed, surrounding the cylinder portions 63, 64, 73 and 74. In the second bobbin 8*b*, the second coil pair 5*b* is housed, surrounding the cylinder portions 63, 64, 73 and 74. Thus, the four lead portions 55, 56, 57 and 58 protrude in the same direction from the respective bobbins.

In this way, a first coil element 2*a* in which the first coil pair 5*a* is housed in the first bobbin 8*a* and a second coil element 2*b* in which the second coil pair 5*b* is housed in the second bobbin 8*b* are produced.

When producing the first coil element 2*a*, as shown in FIG. 5, the coil pair 5*a* is engaged to the first bobbin piece 6, and in this state, the second bobbin piece 7 is bonded to the first bobbin piece 6.

When producing the second coil element 2*b* as well, the coil pair 5*b* is engaged to the first bobbin piece 6, and in this state, the second bobbin piece 7 is bonded to the first bobbin piece 6.

The two bobbin pieces 6 and 7 have bonding portions that are shaped to engage with each other, and the bonding state is maintained by the friction force of the bonding portions or the adhesion force of an adhesive.

Then, the first coil element 2*a* and the second coil element 2*b* are fitted to each other in a posture shown in FIGS. 6 to 9. By doing so, the recess portion 21 of the first coil element 2*a* and the recess portion 21 of the second coil element 2*b* engage with each other in a depth direction, the front ends of the coupling portions 85 and 86 are positioned by being brought into contact with each other, the four coil portions 51, 52, 53 and 54 are positioned in the same plane, and among the four case portions 81, 82, 83 and 84, the perimeter walls of adjacent case portions are bonded in close contact to each other.

Figure 10:
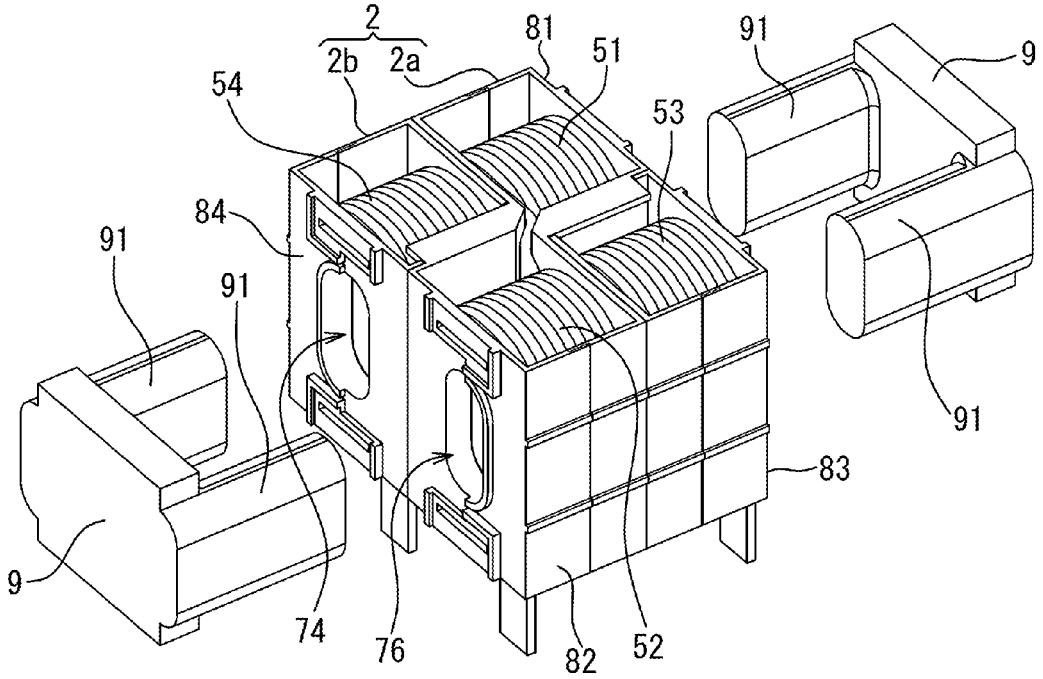
FIG. 10 is a perspective view showing a coil assembly and a pair of cores.

As a result, a coil assembly 2 as shown in FIG. 10 is obtained in which the four case portions 81, 82, 83 and 84 are disposed in four quadrants and do not move relative to each other.

In the coil assembly 2, the first coil portion 51 and the fourth coil portion 54 are coaxially aligned, and the second coil portion 52 and the third coil portion 53 are coaxially aligned. Also, the first coil portion 51 and the third coil portion 53 are arranged side by side in a right-left direction, and the second coil portion 52 and the fourth coil portion 54 are arranged side by side in the right-left direction.

Figure 11:
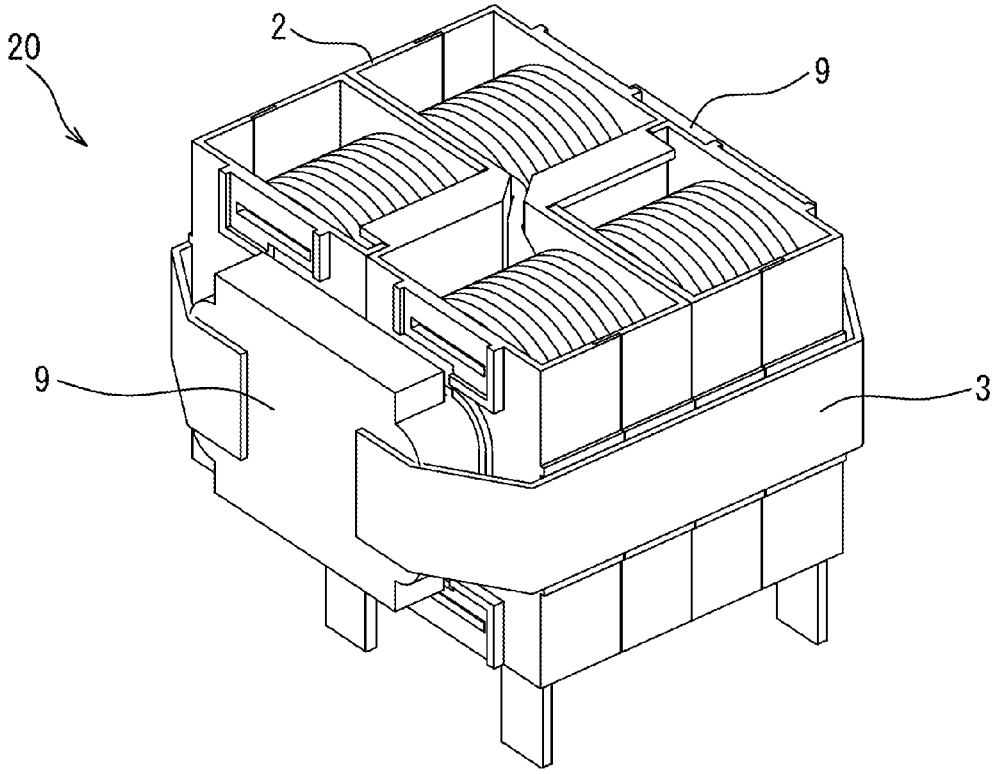
FIG. 11 is a perspective view showing the coil assembly in a clamped state.

Also, the coil assembly 2 includes two parallel core insertion holes constituted by the through holes 65, 66, 75 and 76. As a result of U-shaped (angular C-shaped) ferrite cores 9 and 9, each having a pair of arm portions 91 and 91, being disposed on opposite sides of the coil assembly 2 so as to sandwich the coil assembly 2, and being clamped to the coil assembly 2 by a clamping member 3, with the pairs of arm portions 91 and 91 being inserted into the core insertion holes of the coil assembly 2, a core attached coil assembly 20 shown in FIG. 11 is obtained.

The coil assembly 2 is made as a unitary body by the two coil elements 2*a* and 2*b* being fitted to each other, and thus it is easy to perform an operation of clamping the two cores 9 and 9 to the coil assembly 2.

In the core attached coil assembly 20, the arm portions 91 and 91 of one of the cores 9 and the arm portions 91 and 91 of the other core 9 are butted against each other, and a looped magnetic path that passes through the inner space of the four coil portions 51, 52, 53 and 54 is thereby formed by the two cores 9 and 9.

Figure 12:
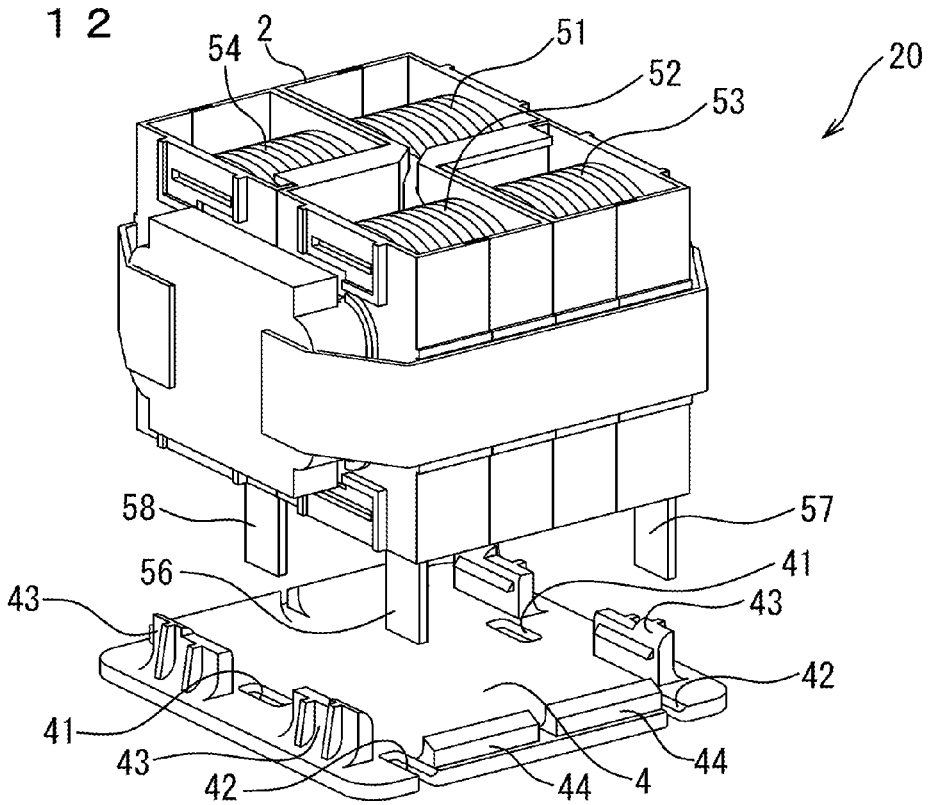
FIG. 12 is a perspective view showing the coil assembly in a clamped state and a base plate.

Finally, as shown in FIG. 12, the core attached coil assembly 20 is installed on a base plate 4, the four lead portions 55, 58, 56 and 57 of the core attached coil assembly 20 are allowed to pass through four lead holes 41, 41, 42 and 42 formed in the base plate 4, and the core attached coil assembly 20 is fixedly supported by a plurality of ribs 43 and 44 provided so as to protrude from the base plate 4.

Through the above process, the common mode choke coil 1 of the present invention shown in FIG. 1 is obtained.

In the common mode choke coil 1 of the present invention, the first coil portion 51 and the second coil portion 52 that are to be connected to one transmission line are disposed in the first quadrant and the third quadrant of an orthogonal coordinate system, the third coil portion 53 and the fourth coil portion 54 that are to be connected to the other transmission line are disposed in the fourth quadrant and the second quadrant of the orthogonal coordinate system, and the four coil portions 51, 52, 53 and 54 to be connected to the two transmission lines are combined in mutually opposite positional relation, which shortens the spatial distance between the coil portions with respect to that of a conventional common mode choke coil. As a result, the coupling factor between two transmission lines in a magnetic circuit formed by the four coil portions 51, 52, 53 and 54 is increased to approximately 0.98.

Also, with the common mode choke coil 1 according to the present invention, the first coil portion 51 and the second coil portion 52 that are to be connected to one transmission line are housed in the first bobbin 8*a* so as to constitute the first coil element 2*a*, the third coil portion 53 and the fourth coil portion 54 that are to be connected to another transmission line are housed in the second bobbin 8*b* so as to constitute the second coil element 2*b*, and the first coil element 2*a* and the second coil element 2*b* are fitted to each other, whereby one common mode choke coil 1 is assembled. Accordingly, in the manufacturing process, two coil elements 2*a* and 2*b* shown in FIGS. 6 to 9 are separately produced, and thereafter, the two coil elements 2*a* and 2*b* are fitted to each other as shown in FIG. 10. By doing so, the two coil elements 2*a* and 2*b* are inseparably coupled to each other, and as a result, a coil assembly 2 in which four coil portions 51, 52, 53 and 54 are made unitary can be obtained. Therefore, the assembling operation becomes easier than a conventional assembling operation.

Furthermore, with the common mode choke coil 1 according to the present invention, the first bobbin 8*a* constituting the first coil element 2*a* and the second bobbin 8*b* constituting the second coil element 2*b* have the same shape, and the two bobbin pieces 6 and 7 constituting each bobbin have the same shape, and thus all of the four bobbin pieces 6, 7, 6 and 7 that are required to constitute the two bobbins 8*a* and 8*b* can be made by resin molding using a common die, and thus the manufacturing cost can be reduced.

Also, as a result of each of the coil portions 51 to 54 being wound in a substantially oval shape, the coil portions do not rotate when the coil portions are inserted into the cylinder portions 63, 64, 73 and 74 and when the coil portions are housed in the bobbins 8*a* and 8*b*, and thus stability can be enhanced. The shape of the coil portions is not limited to a substantially oval shape, and it is possible to select any shape such as a substantially circular shape, a rectangular shape or the like. It is also possible to select a circular coil shape.

The description of the foregoing embodiment is for describing the present invention, and should not be interpreted as limiting or restricting the scope of claims of the present invention. Furthermore, it goes without saying that the configurations of the constituent elements of the present invention are not limited to those in the embodiment, and that various modifications are possible within the technical scope of the claims.

For example, the base plate 4 shown in FIG. 12 can be omitted. Also, the two bobbin pieces 6 and 7 that are bonded to each other can be formed to have different shapes. Furthermore, the two bobbins 8*a* and 8*b* can be formed to have different shapes.

What is claimed is:

1. A common mode choke coil, comprising:

a plurality of coil portions wherein pairs of coil portions connected in series to each other are respectively provided in a plurality of transmission lines connecting a power source and a load, the plurality of coil portions being disposed along one plane, wherein each of the pairs of coil portions are disposed in diagonally opposite positions with an origin of a two-dimensional coordinate system being set as a center, and are housed in a shared bobbin formed extending across the diagonally opposite positions, the bobbin includes a pair of rectangular cylindrical case portions that house the pair of coil portions, a coupling portion that diagonally couples the pair of case portions and that extends to a middle in a height direction of the case portions, and a recess portion that is continuous with the coupling portion and that is formed between corners of the case portions that are adjacent to each other, and a plurality of the bobbins are coupled by fitting the coupling portion of one of the bobbins to the recess portion of the other bobbin.

2. A common mode choke coil, comprising:

a first coil portion and a second coil portion that are connected in series to each other between a first terminal and a second terminal; and a third coil portion and a fourth coil portion that are connected in series to each other between a third terminal and a fourth terminal, the four coil portions being respectively disposed in four quadrants of an orthogonal coordinate system, and an annular core passing through inner spaces of the four coil portions, wherein the first coil portion and the second coil portion are respectively disposed in a first quadrant and a third quadrant of the orthogonal coordinate system and housed in a first bobbin, and the third coil portion and the fourth coil portion are respectively disposed in a fourth quadrant and a second quadrant of the orthogonal coordinate system and housed in a second bobbin, the first bobbin includes a pair of rectangular cylindrical case portions that house the first coil portion and the second coil portion, a coupling portion that diagonally couples the pair of case portions and that extends to a middle in a height direction of the case portions, and a recess portion that is continuous with the coupling portion and that is formed between corners of the case portions that are adjacent to each other, the second bobbin includes a pair of rectangular cylindrical case portions that house the third coil portion and the fourth coil portion, a coupling portion that diagonally couples the pair of case portions and that extends to a middle in a height direction of the case portions, and a recess portion that is continuous with the coupling portion and that is formed between corners of the case portions that are adjacent to each other, and the first bobbin and the second bobbin are coupled by fitting the coupling portion of one of the bobbins to the recess portion of the other bobbin, the pair of case portions of the first bobbin are disposed in the first quadrant and the third quadrant of the orthogonal coordinate system, and the pair of case portions of the second bobbin are disposed in the fourth quadrant and the second quadrant of the orthogonal coordinate system.

3. The common mode choke coil according to claim 2, wherein the first coil portion and the fourth coil portion are coaxially disposed, the second coil portion and the third coil portion are coaxially disposed, the first coil portion and the third coil portion are arranged side by side in parallel to each other, and the second coil portion and the fourth coil portion are arranged side by side in parallel to each other.

4. The common mode choke coil according to claim 3, wherein the first bobbin and the second bobbin have a same shape.

5. The common mode choke coil according to claim 4, wherein the first bobbin and the second bobbin are each formed by two bobbin pieces of a same shape being bonded to each other.

6. The common mode choke coil according to claim 2, wherein the first coil portion and the second coil portion are produced by one conducting wire being continuously wound, the first coil portion and the second coil portion are connected to each other via a connecting portion, the third coil portion and the fourth coil portion are produced by one conducting wire being continuously wound, and the third coil portion and the fourth coil portion are connected to each other via a connecting portion.

* * * * *